United States Patent [19]

Van Gorkum et al.

[11] Patent Number: 4,758,762

[45] Date of Patent: Jul. 19, 1988

[54] CATHODE RAY TUBE HAVING A MAGNETIC FOCUSING LENS

[75] Inventors: Aart A. Van Gorkum, Tokyo, Japan; Martinus H. L. M. Van Den Broek; Robert H. J. Fastenau, both of Eindhoven, Netherlands

[73] Assignee: U.S. Philips Corporation, New York, N.Y.

[21] Appl. No.: 59,728

[22] Filed: Jun. 9, 1987

[30] Foreign Application Priority Data

Jun. 11, 1986 [NL] Netherlands ..... 8601512

[51] Int. Cl.[4] ..... H01J 29/56; H01J 29/64

[52] U.S. Cl. ..... 313/440; 313/442

[58] Field of Search ..... 313/442, 431, 440

[56] References Cited

U.S. PATENT DOCUMENTS 3,230,415 1/1966 Kratochvil et al. ..... 313/442

4,642,527 2/1987 Takahashi et al. ..... 313/431 X

FOREIGN PATENT DOCUMENTS 2085698 4/1982 United Kingdom .

*Primary Examiner*—Palmer C. DeMeo

*Attorney, Agent, or Firm*—Robert J. Kraus

[57] ABSTRACT

A monochrome cathode ray tube having an electromagnetic deflection unit (9) and a directly adjoining integrated focusing multipole correction unit (10) which serves both to generate a static focusing field and to generate higher order multipole correction fields to correct for spot distortion errors. In particular quadrupole fields are generated to correct for astigmatism errors.

4 Claims, 2 Drawing Sheets

CATHODE RAY TUBE HAVING A MAGNETIC FOCUSING LENS

BACKGROUND OF THE INVENTION

The invention relates to a monochrome cathode ray tube comprising at one end an electron gun and at the oppositely-located end a display screen having a phosphor layer. A deflection unit is provided around the neck of the display tube and a magnetic focusing device is provided between the elecron gun and the deflection unit, around the neck of the display tube for generating a static focusing field.

For focusing electrons in a cathode ray tube two types of lenses are used, electrostatic ones or magnetic ones. In order to achieve a high definition it is desired to achieve a very good extent of focusing to produce a small electron spot and thus obtain high resolution. Magnetic lenses may generally be provided outside the neck of the tube, this in contrast with electrostatic lenses which are present in the neck of the tube. As a result of this the diameter of the magnetic lenses may be larger, which provides a better lens quality because spherical aberration decreases when the lens diameter increases. A smaller spherical aberration leads to a smaller spot on the screen, which is required for high resolution guns. For higher resolution e.g. (projection) television tubes a magnetic focusing lens is hence preferably used.

When magnetic focusing lenses are used, they may be distinguished between two types: electromagnetic lenses, and magnetostatic lenses. In an electromagnetic lens a field is generated by a coil enclosed partly by a yoke. In a permanent magnetic lens the field is generated by a permanent magnetic material whether or not provided with a yoke (DE-PS No. 891 119). The electron beam is also moved over the screen by a deflection coil, the intensity of the beam being modulated to obtain a picture. The great beam angular aperture which is associated with the use of a focusing lens having a large diameter has for its result that upon deflecting the beam by the deflection coil the electron spot on the screen is not only enlarged but also distorted. As a result of this deflection defocusing an elliptical spot having a diameter which is larger than that in the centre of the display screen is formed at the edge of the screen.

In some applications of cathode ray tubes, for example projection television tubes or so-called data graphic display tubes, such a distortion cannot be tolerated.

SUMMARY OF THE INVENTION

It is an object of the invention to provide a cathode ray of the type having a magnetic focusing lens with means to correct such astigmatic errors. This object is achieved in a cathode ray tube according to the invention in that the means to generate the static focusing field directly adjoin the deflection unit and also generate higher order multipole fields to correct spot distortion errors.

Essential for the invention is that the multipole correction fields are generated at the area where the beam diameter in the tube is largest. With this large beam diameter the influence of the multipole correction fields is greatest. This is the case at the area of the magnetic focusing lens. A further advantage of this way of generating the multipole correction fields is that the magnetic focusing lens directly adjoins the deflection unit and hence is placed as near as possible to the display screen.

As a result of this an optimum resolution is maintained. When multipole correction means are provided between the magnetic focusing lens and the deflection coil, in itself a place which is not unusual for magnetic correction means, the resolution will no longer be optimum.

Within the scope of the invention the multipole correction fields may in particular be quadrupole fields (to correct astigmatism errors) optionally in combination with six-pole fields (to correct higher order spot distortions) and they can be realized in various manners.

According to a first embodiment of the invention an integrated focusing and multipole correction unit is obtained by composing the yoke of the focusing device entirely or partly from eight equal parts each having a longitudinal coil. By energizing the longitudinal coils correctly a rotationally symmetrical focusing field can be generated on which a quadrupole field to correct astigmatism errors is superimposed.

An integrated focusing and multipole correction unit is alternatively obtained by composing the focusing device of eight coplanar bar magnets which are ordered for generating a static focusing field and by placing a core around each bar magnet. When the coils are energized correctly in which two oppositely located coils always convey the same current, any desired quadrupole field may be generated to correct astigmatism errors.

BRIEF DESCRIPTION OF THE DRAWING

A few embodiments of the invention will be explained in greater detail with reference to the drawing, in which.

FIG. *2a* is a longitudinal sectional view and

Figure 1:
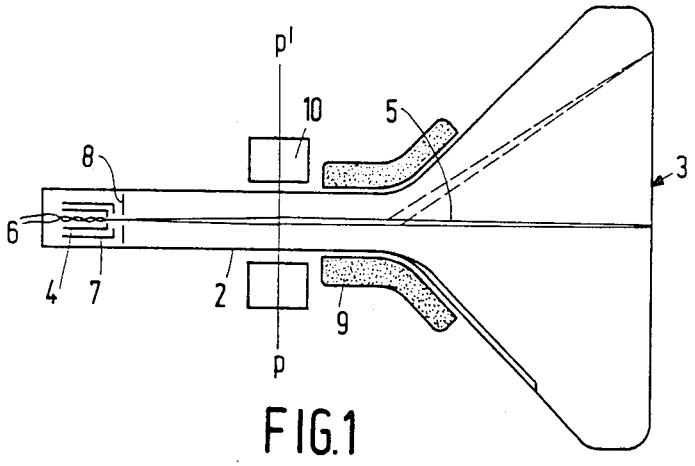
FIG. 1 is a longitudinal sectional view through a cathode ray tube having an integrated focusing and multipole correction unit according to the invention.
Figure 4:
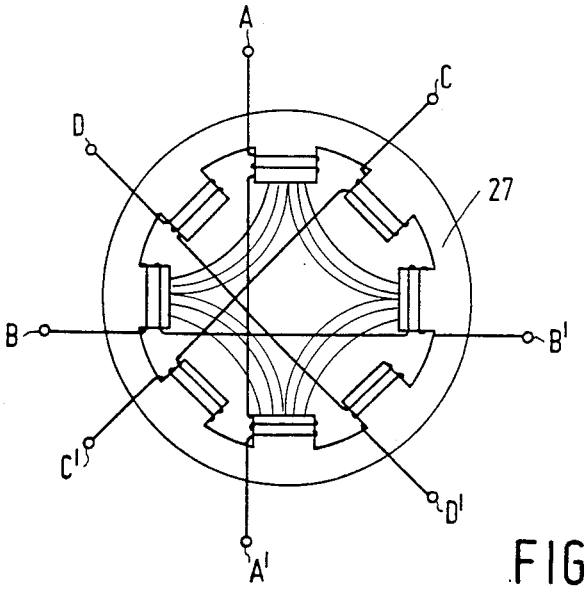

FIG. *2b* is a cross-sectional view taken on the line PP' through an integrated focusing multipole correction unit for the FIG. 1 cathode ray tube (first embodiment);

FIG. *3a* is a longitudinal sectional view and FIG. *3b* a cross-sectional view through an integrated focusing multipole correction unit for the FIG. 1 cathode ray tube (second embodiment); and FIG. 4 shows a diagram for connecting a multipole correction coil.

DESCRIPTION OF THE PREFERRED EMBODIMENTS

An integrated focusing multipole correction unit 10 is assembled around the neck 1 of a cathode ray tube 3. The tube 3 has a cathode 4 to produce an electron beam 5 in cooperation with a heating element 6, a grid 7, and an anode 8. Deflection coils (not shown) are mounted on a deflection yoke 9 on the neck 2 of the tube 3.

Figure 2A:
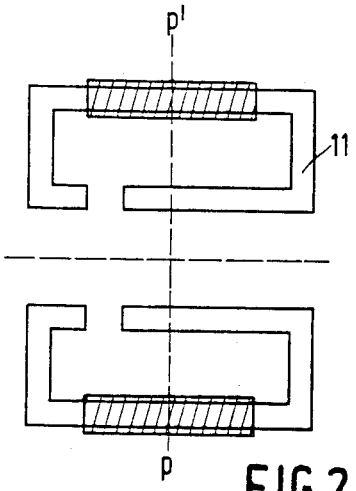
Figure 2B:
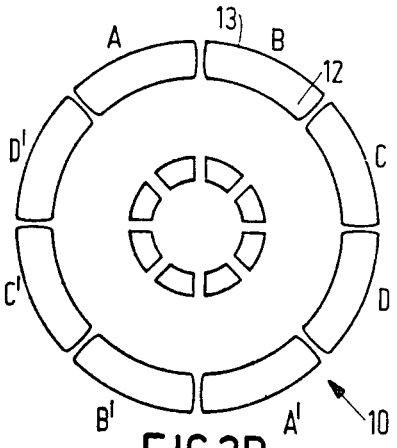

Referring now to FIGS. 2A and 2B it is suggested to divide the yoke 11 of a focusing unit into eight segments. Each of the segments 12 as shown in FIGS. 2A and 2B is provided with a coil 13 in the case of an electromagnetic focusing unit. In the alternative case of a permanent magnetic focusing unit it is suggested to place eight radial bar magnets 14 between a divided inner yoke 15 and an undivided outer yoke 16, as shown in FIGS. *3a* and *3b*. The inner yoke 15 is divided into eight parts. In this case, two gaps are formed which generate an opposite magnetic field. A coil 17 is wound around each of the bar magnets.

If an equal current is sent through the eight coils 13 in the electromagnetic case a static rotationally symmetrical focusing field is generated. Ir an extra current I is conveyed through A and A' and the current in the coils C and C' is reduced by I a quadrupole field superimposed upon the rotationally symmetrical focusing field is generated. By controlling the current through the coils B, B', D and D', the quadrupole field can be rotated in any desired direction. It is to be noted that the eight coils may advantageously be constructed so as to form two sub-coil systems, one having a high L value for a fixed adjustment of the focusing field (this system may optionally be replaced by a system of permanent magnets) and one having a low L value for a dynamic drive of the focusing field.

Figure 3A:
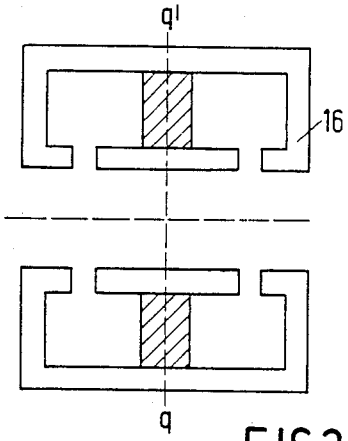
Figure 3B:
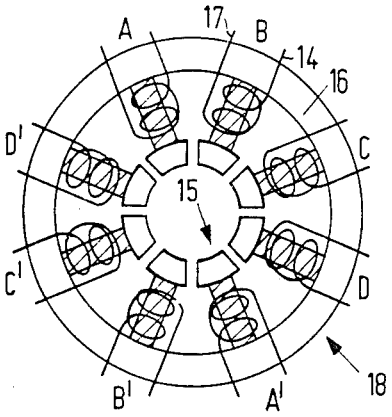

In the case of the permanent magnetic lens 18 (FIG. 3B) the static focusing field is made by means of the eight bar magnets 14. If the strength of the focusing lens is to be varied, either an equal current can be sent through all the coils 17, or extra coils (not shown) may be used which may be provided in the lens.

The quadrupole fields are generated by passing the desired current through the eight coils 17, always two oppositely located coils conveying the same current.

The end in view is reached by the configuration shown, namely that the multipole corrections are made in the place where the beam has its largest diameter: in the focusing lens. Herewith it is always achieved that the two functions of focusing and spot correction take place in the same unit.

A multipole correction coil 27 can be switched as is shown in FIG. 4. By energization of the supply lines such a quadrupole field can be generated that distortion of the spot is corrected. With equal currents through A-A' and B-B' the quadrupole shown is formed. The required corrections depend on the position of the electron spot on tne screen and these currents are hence varied synchronously with the deflection current. The driving may take place both completely analog and via a digital process (GB-A No. 2 085 698).

It is to be noted that the multipole shoes in the figures are shown with single turns to produce the individual poles, the turns not overlapping each other. However, the invention also relates to the use of multipole coils which show a so-called cosinusoidal distribution of the turns in behalf of an improved homogeneity of the generated multipole field.

What is claimed is:

1. In a monochrome cathode-ray tube comprising an envelope containing a luminescent screen, an electron gun for producing an electron beam directed toward screen, and having a neck portion around which deflection means is disposed for deflecting the electron beam across the screen, the improvement comprising magnetic focusing means disposed around the neck adjacent the deflection means for simultaneously producing a static magnetic focusing field for focusing the electron beam into a spot on the screen and a higher-order multipole magnetic correction field for correcting distortion of the spot as the electron beam is deflected away from a central area of the screen, said magnetic focusing means being adapted to produce said multipole field at a place in the envelope where the electron beam diameter is a maximum.

2. A monochrome cathode-ray tube as in claim 1 where the magnetic focusing means comprises a yoke including eight substantially identical portions supporting respective coils for producing the focusing and correction fields, said correction field comprising a quadrupole field for correcting astigmatism of the focusing field.

3. A monochrome cathode-ray tube as in claim 2 where the eight portions support a first coil system having a high impedance for producing the static focusing field and a second coil system having a low impedance for producing a dynamically-varying focusing field.

4. A monochrome cathode-ray tube as in claim 1 where the magnetic focusing means comprises eight permanent magnets arranged around the neck of the envelope for producing the static focusing field, said magnets supporting respective coils for producing the correction field, said correction field comprising a quadrupole field for correcting astigmatism of the focusing field.

* * * * *